US007382220B2

(12) United States Patent
Keller

(10) Patent No.: US 7,382,220 B2
(45) Date of Patent: Jun. 3, 2008

(54) IGNITION COIL FOR AN INTERNAL COMBUSTION ENGINE

(75) Inventor: Wolfgang Keller, Rettenberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/644,417

(22) Filed: Dec. 22, 2006

(65) Prior Publication Data

US 2007/0182518 A1 Aug. 9, 2007

(30) Foreign Application Priority Data

Dec. 23, 2005 (DE) ..... 10 2005 062 127

(51) Int. Cl.
*H01F 27/02* (2006.01)

(52) U.S. Cl. ..... 336/90; 336/92; 336/96

(58) Field of Classification Search ..... 336/90, 336/92, 96; 123/634, 635
See application file for complete search history.

(56) References Cited

U.S. PATENT DOCUMENTS 6,213,109 B1 * 4/2001 Satoo et al. ..... 123/634
6,639,498 B2 * 10/2003 Shimada et al. ..... 336/96
2002/0000765 A1 * 1/2002 Suzuki ..... 313/141
2003/0080843 A1 * 5/2003 Wada et al. ..... 336/90
2003/0169141 A1 * 9/2003 Nagata et al. ..... 336/96
2004/0183638 A1 * 9/2004 Wada ..... 336/177

FOREIGN PATENT DOCUMENTS

DE 299 16 146 2/2001

* cited by examiner

*Primary Examiner*—Anh T Mai
(74) *Attorney, Agent, or Firm*—Kenyon & Kenyon LLP

(57) ABSTRACT

An ignition coil for an internal combustion engine has a rod-shaped magnetic core, which collaborates with a cushioning element in the axial direction. The magnetic core and the cushioning element are furthermore inserted into a secondary coil shell. Moreover, the coil shell has an ignition coil housing, which is filled at least partially with an epoxy resin. In order to avoid that the epoxy resin gets into the gap between the coating and the magnetic core, the cushioning element is developed as a sealing element at the same time. At the same time, the secondary coil shell has a coating on its inner wall for the accommodation of radial stresses. The ignition coil thus designed is developed to be relatively compact, and has good thermomechanical properties.

7 Claims, 2 Drawing Sheets

IGNITION COIL FOR AN INTERNAL COMBUSTION ENGINE

BACKGROUND INFORMATION

An ignition coil is described in U.S. Pat. No. 6,208,231. The ignition coil has a rod-shaped magnetic core which is covered by a disk-shaped cushioning element at at least one end face (FIGS. 8, 9). The cushioning element is used for the compensation of stresses in the axial direction of the magnetic core based on different coefficients of thermal expansion of the different component parts. Furthermore, the magnetic core is surrounded by a flexible element, for instance, a shrink tube. The shrink tube is used for the compensation of stresses in the radial direction. The component parts are situated within a coil shell. During the production of the ignition coil, the ignition coil housing is filled with an insulating resin used as a sealing compound which fills out cracks that may be present in the interior of the ignition coil. During the pouring of the insulating resin, in order to avoid that insulating resin gets into the annular gap between the magnetic core, including the shrinking tube, and the coil shell, an additional closure element is provided which encloses the coil shell at the inner circumference and seals it from the direction of the magnetic core and the shrinking tube. A disadvantage with this is that mounting the closure element means an additional working step, and the closure element requires additional space in the longitudinal direction of the ignition coil. Furthermore, because of its thickness, the shrinking tube requires space which enlarges the diameter of the ignition coil.

It is also known from U.S. Pat. No. 6,208,231 (FIGS. 16, 17) that one may furnish the outer coil shell with a coating which, based on its low adhesive strength to the component parts, makes possible a relative motion of the component parts with respect to one another, and thus a dissipation of stress.

It is also known from German Patent No. DE 299 16 146 that one may coat the magnetic core with a plastic used as a separator, so that the magnetic core does not undergo any bonding with the insulating resin. In this case, the insulating resin fills out the annular space between the magnetic core and the coil shell. This design approach, too, requires an additional working step, because of the application of the separator onto the magnetic core.

SUMMARY OF THE INVENTION

The ignition coil according to the present invention for an internal combustion engine has the advantage that a compensation of stresses between the magnetic core and the coil shell is made possible while having little radial loss of space, at the same time a simple sealing of the coil interior from penetration of insulating resin taking place. According to the present invention, this is essentially achieved in that, for the compensation of axial stresses, the compensation element effects a sealing of the coil interior at the same time, and in that the interior coil shell has a coating on its inner surface that faces the magnetic core, which has damping properties for accommodating radial stresses.

DETAILED DESCRIPTION

Figure 1:
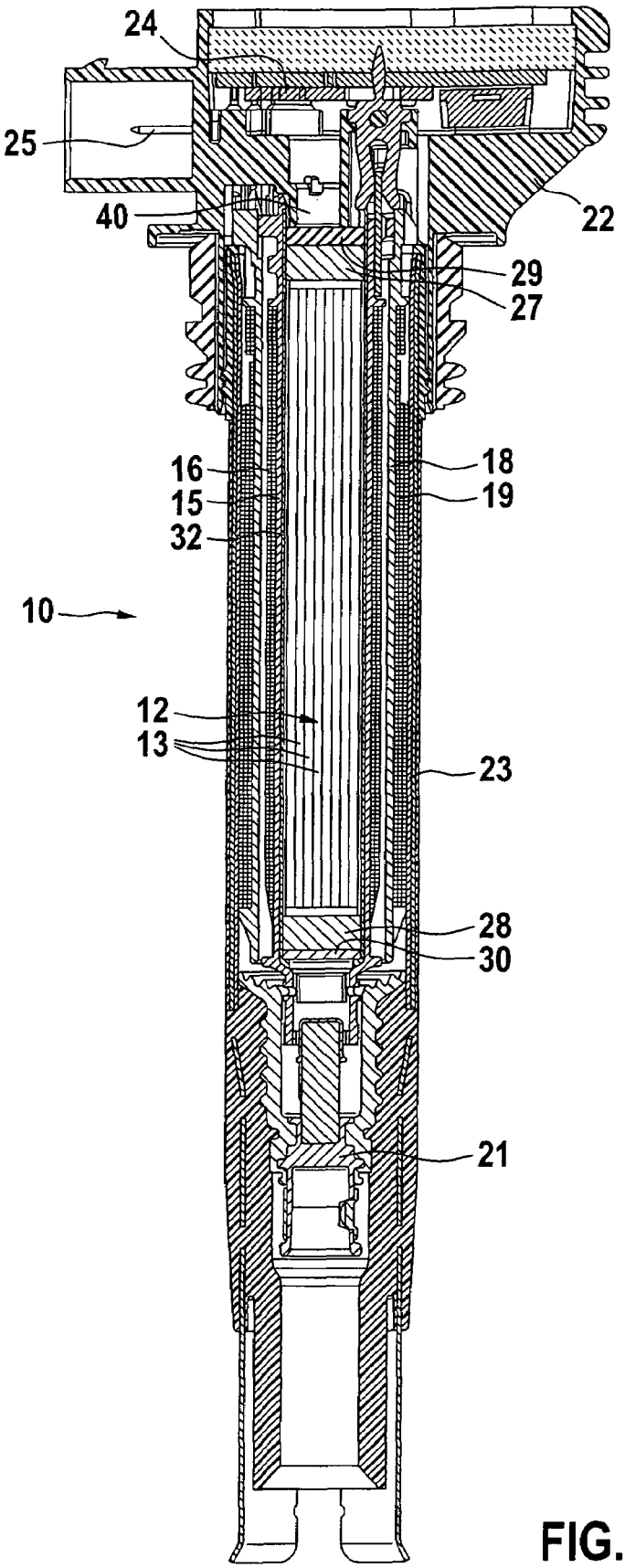
FIG. 1 shows a longitudinal section through an ignition coil for an internal combustion engine, according to the present invention.

Ignition coil 10 shown in FIG. 1 is designed as a so-called rod-type ignition coil and is used for the direct contacting of a spark plug (not shown) of an internal combustion engine. Ignition coil 10 has a magnetically active core 12 which is usually composed of a multitude of rectangular sheet metal strips 13 that have different widths, however, made up of ferromagnetic material, so that an essentially circular cross sectional area is achieved.

A secondary coil having a secondary coil shell 15 and a secondary coil winding 16 as well as a primary coil having a primary coil shell 18 and a primary winding 19 are situated concentrically about core 12. Secondary winding 16, which carries high voltage, is coupled electrically to a sleeve-shaped contacting element 21, which accommodates the head of the spark plug. Contacting element 21 and the primary coil are situated inside an ignition coil housing 22, whose upper region is made of plastic, and which defines the outer form of ignition coil 10. In addition, a longitudinally slotted, sleeve-shaped magnetic yoke element 23 for the magnetic circuit is situated inside ignition-coil housing 22.

Disposed inside ignition-coil housing 22, on the side of primary coil lying opposite from contacting element 21, is an electric circuit 24 coupled to primary winding 19. Electric circuit 24 is coupled to the on-board voltage of the motor vehicle via connector plugs 25. An ignition coil 10 described so far, as well as its method of functioning, are already known in general and are therefore not elucidated further.

Figure 2:
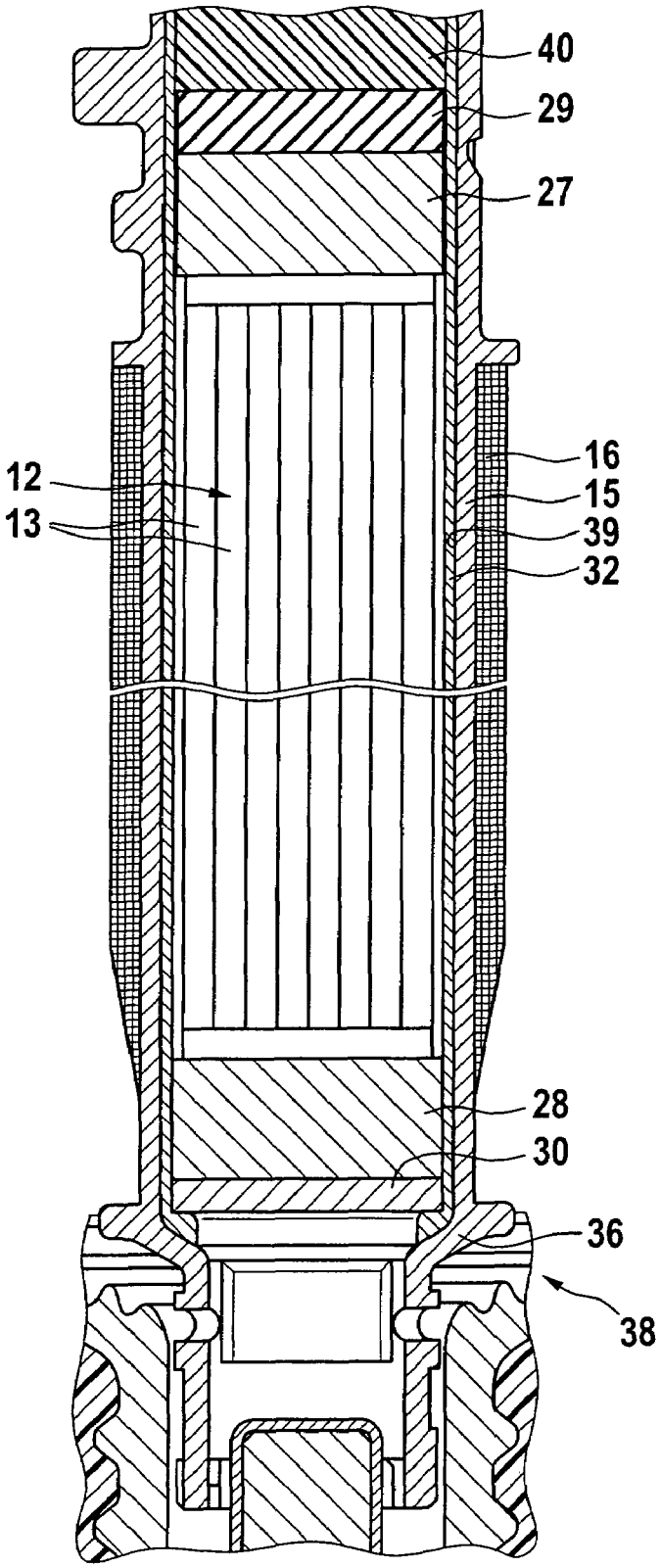
FIG. 2 shows a part of the ignition coil according to FIG. 1, in the region of the magnetic core, also in longitudinal section.

As is seen best in FIG. 2, a disk-shaped magnet 27, 28 is situated at each of the opposite end faces of core 12. On the side facing electric circuit 24, the one magnet 27 is covered by a disk-shaped, elastic cushioning element 29. Cushioning element 29 is preferably made up of a foamed silicone disk, which is developed in closed-pore fashion at least on the side facing away from core 12. On the side facing contacting element 21, the other magnet 28 is covered by a core-covering disk 30, which may also be left out, however, depending on the application.

Core 12, magnets 27, 28, cushioning element 29 and core-covering disk 30 are situated inside secondary coil shell 15 At its inner circumference, secondary coil shell 15 has a coating 32, at least in the region of the component parts just discussed. Coating 32 is made up especially of silicone, and is applied by a spraying or dipping process. Coating 32 should have the property of not bonding or adhering to core 12. Furthermore, coating 32 should have such an elasticity and layer thickness that, in case of a contact with core 12, a stress compensation in the radial direction of core 12 is made possible, based on different temperature coefficients of expansion of core 12 and secondary coil shell 15 and the component parts surrounding core 12. Cushioning element 29 has such a diameter that cushioning element 29 lies against coating 32 closely and tightly with its outer circumference.

Core 12, magnets 27, 28, cushioning element 29 and, if present, core cover disk 30 are inserted into secondary coil shell 15 during the assembly of ignition coil 10, the component parts being able to lie against the inner wall of secondary coil shell 15. Secondary coil shell 15 is designed to be sleeve-shaped for this and has a circular inside cross sectional plane. On its side facing contacting element 21, secondary coil shell 15 has a section 38 that is reduced at least in its inside diameter and has a gradation (step) 36.

Since core 12 and secondary coil shell 15 and the component parts of ignition coil 10 surrounding it have different heat expansion coefficients, during the operation of the internal combustion engine, and the heating up connected with it, the component parts expand differently. If there were a firm bond between certain component parts, such as between core 12 and secondary coil shell 15, this could lead to cracks based on the stresses, which would restrict the functioning of ignition coil 10. In order to compensate for these stresses, secondary coil shell 15 is furnished with coating 32, which makes possible a stress compensation in the radial direction of core 12. In the axial direction of core 12, the compensation for the stresses takes place using cushioning elements 29.

After all the component parts have been inserted into ignition coil housing 22 and the electrical contacting has been established, ignition coil housing 22 is filled with an epoxy resin 40 used as sealing compound from the upper end, that is, from the end of contact plug 25. In the process, epoxy resin 40 reaches right up to cushioning element 29, at least on the side facing connecting plugs 25. However, because of its closed-pore design, no epoxy resin 40 penetrates into cushioning element 29. Also, because of the radial sealing between cushioning element 29 and coating 32, no epoxy resin 40 penetrates into the interior of secondary coil shell 15 and thus into the region of core 12. Epoxy resin 40 is intended to help avoid air pockets in ignition coil 10 and to decouple electrically the individual component parts from one another, and at the same time fix them mechanically. For these purposes, ignition coil housing 22, including the component parts located in it, is placed in a vacuum in a device, during the introduction of the sealing compound, to support driving out air pockets and to speed up the pouring process.

In the exemplary embodiment shown, in order also to prevent the penetration of epoxy resin 40 from the side of contacting elements 21 into the annular shaped space between secondary coil shell 15 and core 12, it is further provided that core-covering disk 30 be pressed against gradation 36 using such an axial force that core-covering disk 30 ensures a sealing.

Air may be trapped in the annular space between core 12 and secondary coil shell 15 during the insertion and positioning of the component parts into secondary coil shell 15, and this will remain trapped there during the subsequent evacuation and the filling of ignition coil housing 22 with epoxy resin 40, because of the sealing described above. Because of the electrically insulating effect of air, this is entirely desirable and advantageous. This effect may be further increased if the insertion of the component parts into secondary coil shell 15 is performed under pressure over atmospheric pressure. Positive effects could also be produced by the insertion under a protective and/or insulating gas atmosphere. If the insertion of the component parts takes place at a pressure over atmospheric pressure, this has the additional advantage that mechanical pressures are distributed particularly well and uniformly via the air or gas, so that no mechanical pressure peaks are created.

We mention, in addition, that sealing at the end of core-covering disk 30 is not required if the secondary coil shell is, for example, not sleeve-shaped but pot-shaped using sealing integrated there. It is also conceivable, at the location of core-covering disk 30, to use other sealing measures, for instance, via separate covering elements. Furthermore, the positioning of secondary coil and primary coil may be exchanged, so that the primary coil surrounds core 12.

What is claimed is:

1. An ignition coil for an internal combustion engine, comprising:

a substantially rod-shaped magnetic core;

a first compensation element acting in an axial direction of the magnetic core;

first and second coil shells situated concentrically with respect to each other, the first coil shell surrounding the magnetic core and the first compensation element, the first coil shell being situated within the second coil shell; and a second compensation element acting in a radial direction and being situated between the magnetic core and the first coil shell, the second compensation element having a closure element for avoiding a penetration of a sealing compound into a space between the magnetic core and the first coil shell, the first compensation element acting as a closure element at the same time, the second compensation element being a coating;

wherein the first coil shell is sleeve-shaped, and a side of the first coil shell that lies opposite to the first compensation element is also sealed;

wherein the first coil shell has a section at its inner wall that is reduced in diameter, at which sealing takes place;

wherein a gradation is situated in the section, against which there is pressed one of (a) the magnetic core, (b) a disk-shaped magnet that follows the magnetic core axially in some instances, and (c) a core-covering disk.

2. An ignition coil for an internal combustion engine, comprising:

a substantially rod-shaped magnetic core;

a first compensation element acting in an axial direction of the magnetic core;

first and second coil shells situated concentrically with respect to each other, the first coil shell surrounding the magnetic core and the first compensation element, the first coil shell being situated within the second coil shell; and a second compensation element acting in a radial direction and being situated between the magnetic core and the first coil shell, the second compensation element having a closure element for avoiding a penetration of a sealing compound into a space between the magnetic core and the first coil shell, the second compensation element being a coating of the first coil shell, the first compensation element acting, at the same time, as a closure element sealing a space between the magnetic core and the first coil shell and interacting with the coating;

wherein the coating is situated on an inner wall of the first coil shell that faces the magnetic core;

wherein the coating is elastic;

wherein a sealing by the first compensation element at the inner wall of the first coil shell takes place because of an elastic deformation of the first compensation element in the radial direction.

3. The ignition coil according to claim 2, wherein the coating is made of silicone.

4. The ignition coil according to claim 2, wherein the first coil shell is sleeve-shaped, and a side of the first coil shell that lies opposite to the first compensation element is also sealed.

5. The ignition coil according to claim 4, wherein the first coil shell has a section at its inner wall that is reduced in diameter, at which the sealing takes place.

6. The ignition coil according to claim 2, wherein one of (a) air, (b) a protective gas and (c) an electrically insulating gas is present in an annular-shaped region between the magnetic core and the first coil shell.

7. The ignition coil according to claim 6, wherein the one of (a), (b) and (c) is under overpressure.

* * * * *